US006238449B1

(12) United States Patent
Woo et al.

(10) Patent No.: US 6,238,449 B1
(45) Date of Patent: May 29, 2001

(54) ABRASIVE ARTICLE HAVING AN ABRASIVE COATING CONTAINING A SILOXANE POLYMER

(75) Inventors: Edward J. Woo; Yeun J. Chou, both of Woodbury; Scott K. Fraser, White Bear Lake, all of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/218,386

(22) Filed: Dec. 22, 1998

(51) Int. Cl.[7] ..... B24D 3/02; B24D 3/28; B24D 11/00

(52) U.S. Cl. ..... 51/298; 51/295; 51/297; 51/306

(58) Field of Search ..... 51/295, 297, 298, 51/306, 309

(56) References Cited

U.S. PATENT DOCUMENTS

| | | |
|---|---|---|
| 2,881,064 | 4/1959 | Rankin et al. . |
| 2,958,593 | 11/1960 | Hoover et al. . |
| 3,256,075 | 6/1966 | Kirk et al. . |
| 3,296,022 | 1/1967 | Timmer et al. . |
| 3,537,121 | 11/1970 | McAvoy . |
| 3,595,738 | 7/1971 | Clarke et al. . |
| 3,605,349 | 9/1971 | Anthon . |
| 3,868,749 | 3/1975 | Cate . |
| 4,170,481 | 10/1979 | Akama et al. . |
| 4,255,164 | 3/1981 | Butzke et al. . |
| 4,480,009 | 10/1984 | Berger . |
| 4,481,280 | 11/1984 | Fujikawa et al. . |
| 4,601,937 | 7/1986 | Latussek . |
| 4,728,571 | 3/1988 | Clemens et al. . |
| 4,903,440 | 2/1990 | Larson et al. . |
| 4,967,456 | 11/1990 | Sternlieb et al. . |
| 4,972,037 | 11/1990 | Garbe et al. . |
| 4,973,338 | 11/1990 | Gaeta et al. . |
| 4,981,903 | 1/1991 | Garbe et al. . |
| 5,014,468 | 5/1991 | Ravipati et al. . |
| 5,015,266 | 5/1991 | Yamamoto . |
| 5,021,477 | 6/1991 | Garbe et al. . |
| 5,032,460 | 7/1991 | Kantner et al. . |
| 5,077,870 | 1/1992 | Melbye et al. . |
| 5,082,720 | 1/1992 | Hayes . |
| 5,143,779 | 9/1992 | Newkirk et al. . |
| 5,152,917 | 10/1992 | Pieper et al. . |
| 5,178,646 | 1/1993 | Barber, Jr. et al. . |
| 5,198,057 | 3/1993 | Newkirk et al. . |
| 5,213,589 | 5/1993 | Ronning et al. . |
| 5,271,997 | 12/1993 | Baigas, Jr. . |
| 5,304,223 | 4/1994 | Pieper et al. . |
| 5,368,925 | 11/1994 | Hosokawa et al. . |
| 5,378,252 | 1/1995 | Follensbee . |
| 5,435,816 | 7/1995 | Spurgeon et al. . |
| 5,437,754 | 8/1995 | Calhoun . |
| 5,453,312 | 9/1995 | Haas et al. . |
| 5,454,844 | 10/1995 | Hibbard et al. . |
| 5,468,477 | 11/1995 | Kumar et al. . |
| 5,489,235 | 2/1996 | Gagliardi et al. . |
| 5,549,961 | 8/1996 | Haas et al. . |
| 5,578,097 | 11/1996 | Gaeta et al. . |
| 5,580,647 | 12/1996 | Larson et al. . |
| 5,624,471 | 4/1997 | Gaeta et al. . |
| 5,663,211 | 9/1997 | Kominami et al. . |
| 5,681,612 | 10/1997 | Benedict et al. . |
| 5,773,120 | 6/1998 | Deka et al. . |
| 5,837,745 | 11/1998 | Safta et al. . |

FOREIGN PATENT DOCUMENTS

| | | |
|---|---|---|
| 0 321 704 A3 | 6/1989 | (EP) . |
| 0 370 658 A2 | 5/1990 | (EP) . |
| 0 500 369 A2 | 8/1992 | (EP) . |
| 0 538 047 A1 | 4/1993 | (EP) . |
| 0 560 059 A2 | 9/1993 | (EP) . |
| 0 625 430 A1 | 11/1994 | (EP) . |
| 2 314 791 | 1/1998 | (GB) . |
| WO 94/04738 | 3/1994 | (WO) . |
| WO 95/07797 | 3/1995 | (WO) . |
| WO 95/22436 | 8/1995 | (WO) . |
| WO 96/21539 | 7/1996 | (WO) . |
| WO 96/33841 | 10/1996 | (WO) . |
| WO 96/37644 | 11/1996 | (WO) . |
| WO 97/14720 | 4/1997 | (WO) . |
| WO 98/03307 | 1/1998 | (WO) . |
| WO 98/12021 | 3/1998 | (WO) . |
| WO 99/65352 | 12/1999 | (WO) . |

OTHER PUBLICATIONS

"Fiber Blends For Thermally Bonded Rebulkable Monomers", Research Disclosure, Nov. 1993, p. 741.

Patent Abstracts of Japan, vol. 13, No. 174, Apr. 25, 1989, Patent No. 01 004667, published Jan. 9, 1989.

*Primary Examiner*—Michael Marcheschi
(74) *Attorney, Agent, or Firm*—Scott R. Pribnow

(57) ABSTRACT

Structured abrasive articles having an abrasive coating including a binder which comprises the reaction product of a binder precursor and a reactive siloxane polymer are described as well as methods of making same. The reactive siloxane polymers have at least one functional group which is capable of reacting with the binder precursor.

38 Claims, 1 Drawing Sheet

ABRASIVE ARTICLE HAVING AN ABRASIVE COATING CONTAINING A SILOXANE POLYMER

BACKGROUND

This invention is directed to an abrasive article having an abrasive coating containing a siloxane polymer.

U.S. Pat. No. 5,152,917 (Pieper et al.) reports abrasive articles which have a structured abrasive coating comprising a plurality of precisely shaped abrasive composites bonded to a backing. The precisely shaped abrasive composites can have a variety of geometric shapes and are formed of a plurality of abrasive particles dispersed in a cured binder.

Structured abrasives can be made in a variety of different coating processes such as reported in U.S. Pat. No. 5,304,223 (Pieper et al.), U.S. Pat. No. 5,435,816 (Spurgeon et al.), U.S. Pat. No. 5,672,097 (Hoopman et al.), and WO 97/12727 (Hoopman et al.). One method of making structured abrasive is to first coat an abrasive slurry (i.e., a plurality of abrasive particles dispersed in a binder precursor) onto a backing. The slurry-coated backing is then brought into contact with a production tool comprising a series of precisely shaped cavities. The cavities have essentially the inverse shape and dimensions of the desired abrasive composites. The abrasive slurry flows into the cavities of the production tool. Next, the binder precursor is exposed to conditions to cure the binder precursor to form an abrasive coating which is bonded to the backing.

The production tool may comprise a continuous thermoplastic sheet or belt that has the desired pattern of precisely shaped cavities embossed into the surface. For a variety of reasons, it is desirable to re-use the production tool multiple times before disposal. In order to re-use the production tool, the previously manufactured abrasive composites must cleanly separate from the cavities of the production tool. If residual portions of abrasive composites remain in the production tool, the cavities will be obstructed, thereby preventing subsequently coated slurry from completely filling the cavities. This may result in a malformed abrasive coating which does not have the desired precisely shaped surface and/or abrasive coating weight.

What is desired is a means to re-use a production tool many times, without adversely affecting the abrasive article formed therefrom.

SUMMARY

This invention pertains to abrasive articles and to methods of making abrasive articles. More particularly, this invention relates to structured abrasive articles having abrasive coatings comprising a reactive siloxane polymer. It has been found that the addition of a reactive siloxane polymer to a structured abrasive coating aids the release of the abrasive coating from the production tool.

In one aspect of this invention, an abrasive article is provided which comprises a backing having adhered to at least one major surface thereof a structured abrasive coating comprising a plurality of abrasive particles dispersed in a binder. The binder comprises the reaction product of a binder precursor and at least one reactive siloxane polymer which is capable of reacting with the binder precursor. Binder precursors include free radically curable materials (e.g., acrylates or methacrylates) and cationically curable materials such as vinyl ethers. The reactive siloxane polymer may be represented by formula (I) or formula (II):

Formula (I) is:

(I)

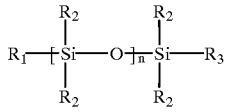

where n is 50 to 1000.

In formula (I), $R_1$ is:

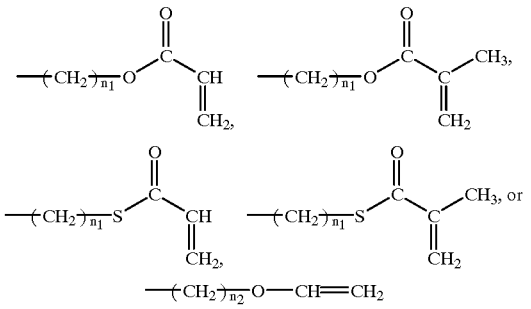

where $n_1$ is an integer from 3 to 12 and where $n_2$ is an integer from 3 to 10.

$R_2$ is independently methyl, ethyl, or phenyl.

$R_3$ is:

an aliphatic group having from 1 to 10 carbon atoms, an aromatic group, preferably having from 6 to 12 carbon atoms.

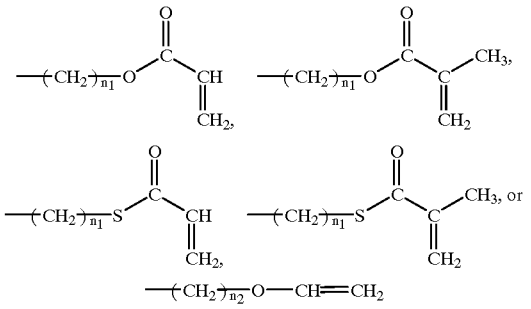

where $n_1$ is an integer from 3 to 12 and where $n_2$ is an integer from 3 to 10.

Formula (II) is:

(II)

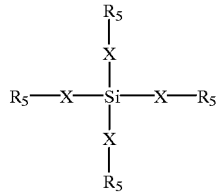

In formula (II), X is:

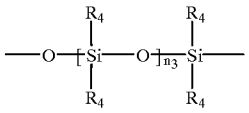

where $n_3$ is an integer from 5 to 500 and where the terminal oxygen atom of X is connected to the Si atom of formula (II).

$R_4$ is independently methyl, ethyl, or phenyl.

$R_5$ is independently:

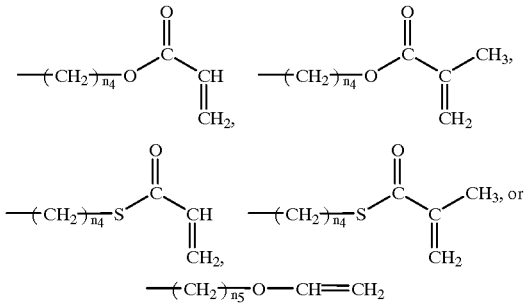

where $n_4$ is an integer from 3 to 12 and where $n_5$ is an integer from 3 to 10.

As used herein "reactive siloxane polymer" or "siloxane polymer" refers to any of the polymers represented by formula (I), formula (II) or a mixture thereof. The reactive siloxane polymers represented by formulas (I) and (II) have at least one functional group that is capable of reacting with the binder precursor. Therefore, the siloxane polymer reacts with the binder precursor and becomes chemically bound (i.e., through covalent chemical bonds) to the cured binder. Functional groups include alpha, beta-unsaturated carbonyl groups (i.e., acrylates, methacrylates, thioacrylates, thiomethacrylates) or vinyl ether groups.

The abrasive coatings of abrasive articles of the present invention are preferably formed by coating an abrasive slurry on a production tool having a surface with a plurality of precisely shaped recesses and then curing the abrasive slurry while the abrasive slurry is both being borne on a backing and filling the precisely shaped cavities. The abrasive slurry comprises abrasive particles, a binder precursor, a reactive siloxane polymer, and desired optional ingredients. The abrasive coating has a structured surface. As used herein "structured abrasive coating" or "structured" means an abrasive coating having a surface topography comprising a plurality of precisely-shaped abrasive composites arranged on a backing in a predetermined array, wherein each composite has a predetermined precise shape. The predetermined array may be random or non-random. As used herein "precisely-shaped" is used to describe abrasive composites having a three dimensional shape defined by relatively smooth surfaced sides that are bounded and joined by well-defined sharp edges having distinct lengths with distinct endpoints defined by the intersections of the sides.

The present invention also relates to a method of making an abrasive article, the method comprising the steps of:

(a) providing an abrasive slurry comprising a plurality of abrasive particles, a binder precursor and a reactive siloxane polymer of formulas (I) or (II) or a mixture thereof;

(b) providing a production tool, wherein the production tool has a plurality of precisely shaped cavities;

(c) applying the abrasive slurry into the cavities of the production tool such that the abrasive slurry is present between the production tool and a major surface of a backing;

(d) exposing the abrasive slurry to an energy source to initiate the cure of the binder precursor; and (e) removing the abrasive article from the production tool.

Curing converts the abrasive slurry into an abrasive coating by converting the binder precursor into a cured binder. It is believed that the siloxane polymer aids in the release of the abrasive coating from the production tool. Release of the abrasive coating from the production tool is important since there is a tendency for small portions of the abrasive coating to stick to the production tool and to remain adhered to the inside of the cavities of the production tool after the abrasive article has been removed. This results in abrasive articles having malformed abrasive coatings and may reduce the number of times that the production tool may be reused, since it becomes clogged with debris from the abrasive coating. If the abrasive coating can be consistently removed cleanly from the production tool then the production tool may be reused many times.

In addition to aiding the release of an abrasive coating from a production tool, the siloxane polymer may reduce the tendency of the abrasive article to load. Loading refers to the tendency for debris generated from sanding to become lodged in between the abrasive particles or in between adjacent abrasive composites.

DETAILED DESCRIPTION

Figure 1:
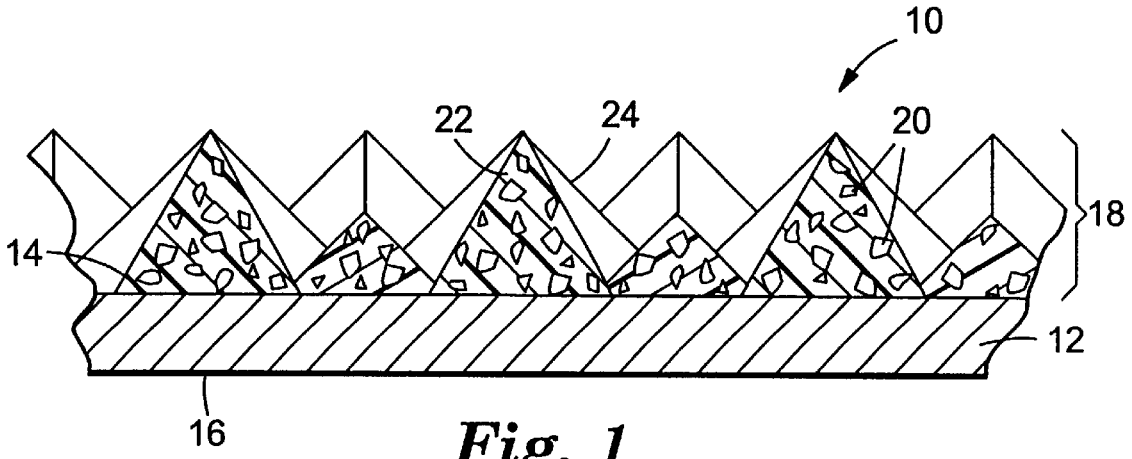
FIG. 1 is a cross sectional view of a first embodiment of a structured abrasive article of the present invention.

This invention pertains to abrasive articles comprising a reactive siloxane polymer and to methods of making the abrasive articles.

Referring to FIG. 1, abrasive article 10 comprises backing 12 having front surface 14 and back surface 16. Structured abrasive coating 18 is bonded to front surface 14 of backing 12. Abrasive coating 18 comprises a plurality of abrasive particles 20 distributed in binder 22. Binder 22 comprises the reaction product of a binder precursor and at least one reactive siloxane polymer. Abrasive coating 18 has a structured surface topography comprising a plurality of precisely shaped abrasive composites 24.

Abrasive Slurry:

Abrasive coatings of abrasive articles of the present invention are formed by curing an abrasive slurry on a substrate. The abrasive slurry comprises a binder precursor, abrasive particles, a reactive siloxane polymer, and may optionally contain other ingredients such as fillers, plasticizers, suspending agents, and surface modification additives. The abrasive slurry is prepared by combining these materials together using any suitable mixing technique. Mixing techniques include both low shear and high shear mixing, with high shear mixing being preferred. Ultrasonic energy may also be utilized in combination with the mixing step to lower the viscosity of the abrasive slurry. Typically, the abrasive particles are gradually added to the binder precursor. It is preferred that the abrasive slurry be a homogeneous mixture of binder precursor, abrasive particles, siloxane polymer, and optional additives. If necessary a solvent may be added to reduce the viscosity. In some instances, it may be preferred to heat the abrasive slurry to a temperature of about 30° C. to 70° C. to reduce the viscosity. It is important that the abrasive slurry be monitored before coating to ensure a coatable rheology and to ensure that the abrasive particles and other additives do not settle before coating. It may also be preferred to continuously mix the abrasive slurry prior to coating to minimize separation of the abrasive particles, fillers, and/or reactive siloxane polymer from the binder precursor.

The components of an abrasive slurry and an abrasive article are described in detail below.

Abrasive Particles:

Abrasive particles typically have a particle size ranging from about 0.001 to about 1500 micrometers, preferably ranging from about 0.01 to about 500 micrometers. It is preferred that the abrasive particles have a Mohs' hardness of at least about 8, more preferably at least about 9. Examples of abrasive particles include fused aluminum oxide, heat treated aluminum oxide, white fused aluminum oxide, black silicon carbide, green silicon carbide, titanium diboride, boron carbide, tungsten carbide, titanium carbide, diamond, silica, iron oxide, chromia, ceria, zirconia, titania, silicates, tin oxide, cubic boron nitride, garnet, fused alumina zirconia, sol gel abrasive particles, and combinations thereof.

The term abrasive particles also encompasses the arrangement where single abrasive particles are bonded together to form an abrasive agglomerate. Abrasive agglomerates are reported in U.S. Pat. No. 4,311,489 (Kressner) and U.S. Pat. No. 4,799,939 (Bloecher et al.).

It is also within the scope of this invention to have a surface coating on the abrasive particles. The surface coating may function, for example, to increase adhesion to the binder or to alter the abrading characteristics of the abrasive particle. Examples of surface coatings include coupling agents, halide salts, metal oxides including silica, refractory metal nitrides, and refractory metal carbides.

Binders/Binder Precursors:

Binder precursors are flowable materials which are capable of being cured to form a substantially non-flowable state. During manufacturing of abrasive articles of the present invention, an abrasive slurry is exposed to an energy source (e.g., thermal energy, electron beam, ultraviolet and/or visible light) to initiate curing of the binder precursor and reactive siloxane polymer. The functional groups of the binder precursor are reactive with one another and are also reactive with the functional groups of the reactive siloxane polymer. After curing, the binder precursor and reactive siloxane polymer are converted into a substantially non-flowable cured binder. Binder precursors which are capable of reacting with reactive siloxane polymers may be either free-radically curable or cationically curable.

A preferred class of binders precursors are free radically curable resins. Examples include aminoplast resins having at least one pendant alpha, beta unsaturated carbonyl group, ethylenically unsaturated resins, acrylated resins (e.g., acrylated isocyanurates, acrylated urethanes, acrylated epoxies, or acrylated polyesters) or mixtures thereof.

The aminoplast resins have at least one pendant alpha, beta-unsaturated carbonyl group per molecule. The alpha, beta-unsaturated carbonyl groups may be acrylates, methacrylates or acrylamides. Examples of such materials include N-(hydroxymethyl)-acrylamide, N,N'-oxydimethylenebisacrylamide, ortho and para acrylamidomethylated phenol, acrylamidomethylated phenolic novolac and combinations thereof. These materials are reported in U.S. Pat. No. 4,903,440 (Larson et al.), U.S. Pat. No. 5,055,113 (Larson et al.) and U.S. Pat. No. 5,236,472 (Kirk et al.), the disclosures of which are incorporated herein by reference.

Ethylenically unsaturated binder precursors may be monofunctional, difunctional, trifunctional, tetrafunctional, or may even have a higher functionality (e.g., hexafunctional). Typically, these materials contain atoms of carbon, hydrogen, oxygen, and optionally nitrogen and the halogens. Ethylenically unsaturated binder precursors preferably have a molecular weight of less than about 4,000 grams/mole and are preferably esters made from the reaction of aliphatic alcohols with unsaturated carboxylic acids (e.g., acrylic acid, methacrylic acid, itaconic acid, crotonic acid, isocrotonic acid, maleic acid, and the like). Representative examples of ethylenically unsaturated binder precursors include methyl methacrylate, ethyl methacrylate, styrene, divinylbenzene, hydroxyethyl acrylate, hydroxyethyl methacrylate, hydroxypropyl acrylate, hydroxypropyl methacrylate, hydroxybutyl acrylate, hydroxybutyl methacrylate, vinyl toluene, ethylene glycol diacrylate, polyethylene glycol diacrylate, ethylene glycol dimethacrylate, hexanediol diacrylate, triethylene glycol diacrylate, trimethylolpropane triacrylate, glycerol triacrylate, pentaerthyitol triacrylate, pentaerythritol trimethacrylate, pentaerythritol tetraacrylate or pentaerythritol tetramethacrylate. Additional examples of ethyleneically unsaturated binder precursors include those reported in U.S. Pat. No. 5,580,647 (Larson et al.), the disclosure of which is incorporated herein by reference.

Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2-acryloxyethyl)isocyanurate, 1,3,5-tri(2-methacryloxyethyl)-s-triazine, acrylamide, methacrylamide, N-methylacrylamide, N,N-dimethylacrylamide, N-vinylpyrrolidone or N-vinyl-piperidone.

Acrylated isocyanurates and acrylated isocyantes are further described in U.S. Pat. No. 4,652,274 (Boetcher et al.), the disclosure of which is incorporated herein by reference. A preferred isocyanurate material is the triacrylate of tris (hydroxy ethyl) isocyanurate.

Acrylated urethanes are acrylate esters of hydroxy terminated isocyanate extended polyesters or polyethers. Examples of acrylated urethanes include those commercially available under the trade designations "UVITHANE 782" (available from Morton Chemical Co.), "CMD 6600", "CMD 8400", and "CMD 8805" (available from UCB Radcure Specialties, Smyrna Ga.).

Acrylated epoxies are acrylate esters of epoxy resins, such as the diacrylate ester of bisphenol A epoxy resin. Examples of acrylated epoxies include those commercially available under the trade designations "CMD 3500", "CMD 3600", and "CMD 3700" (available from UCB Radcure Specialties, Smyrna Ga.).

The binder precursor may also comprise an acrylated polyesters resin. Examples of acrylated polyesters include those commercially available under the trade designations "PHOTOMER 5007" (2000 molecular weight hexafunctional acrylate) and "PHOTOMER 5018" (1000 molecular weight tetrafunctional tetraacrylate) ("PHOTOMER" resins are available from Henkel Corp., Hoboken, N.J.). Additional examples of acrylated polyesters include those commercially available under the trade designations "EBECRYL 80" (1000 molecular weight tetrafunctional modified polyester acrylate), "EBECRYL 450" (fatty acid modified polyester hexaacrylate) and "EBECRYL 830" (1500 molecular weight hexafunctional polyester acrylate) ("EBECRYL" resins are available from UCB Radcure Specialties).

Epoxy resins are oxiranes and are polymerized by ring opening. Epoxy binder precursors can polymerize via a cationic mechanism with the addition of a suitable cationic curing agent. Such epoxide resins include monomeric epoxy resins and oligomeric epoxy resins. Examples of some preferred epoxy resins include 2,2-bis[4-(2,3-epoxypropoxy)-phenyl propane] (i.e., the diglycidyl ether of bisphenol) and commercially available materials under the trade designation "EPON 828", "EPON 1004", and "EPON 1001F" (available from Shell Chemical Co.), "DER-331", "DER-332", and "DER-334" (available from Dow Chemical Co.). Other suitable epoxy resins include glycidyl ethers of phenol formaldehyde novolac such as "DEN-431" and "DEN-428" (available from Dow Chemical Co.).

It is also within the scope of this invention for the binder precursor to comprise a blend of a free radical curable resin with a non-free radical curable resin. For example, a free radical curable resin could be blended with a phenolic resin, urea-formaldehyde resin, or an epoxy resin. In this instance, the portion of the binder precursor which is not free-radically curable (e.g., the phenolic resin) may not react with the reactive siloxane polymer. Additional information of blending acrylate resins with epoxy resins may be found in U.S. Pat. No. 4,751,138 (Tumey et al.), the disclosure of which is incorporated herein by reference.

Reactive Siloxane Polymer:

The abrasive coating of an abrasive article of the present invention includes a reactive siloxane polymer having at least one reactive group that is capable of reacting with the binder precursor. Hence, the reactive siloxane polymer reacts with the binder precursor forming covalent chemical bonds between the binder precursor and the reactive siloxane polymer.

A monofunctional or difunctional reactive siloxane polymer is represented by the general formula (I):

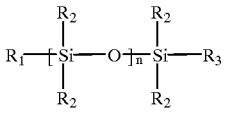

(I)

where n is 50 to 1000.

In formula (I), $R_1$ is:

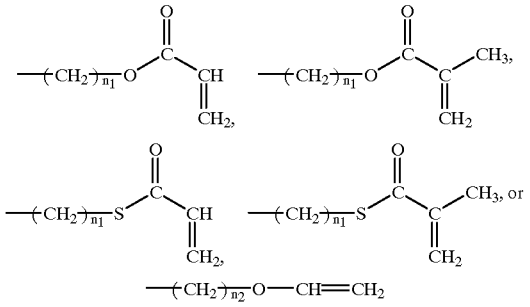

where $n_1$ is an integer from 3 to 12 and where $n_2$ is an integer from 2 to 10.

$R_2$ is independently methyl, ethyl, or phenyl.

$R_3$ is:

an aliphatic group having from 1 to 10 carbon atoms, an aromatic group, preferably having from 6 to 12 carbon atoms,

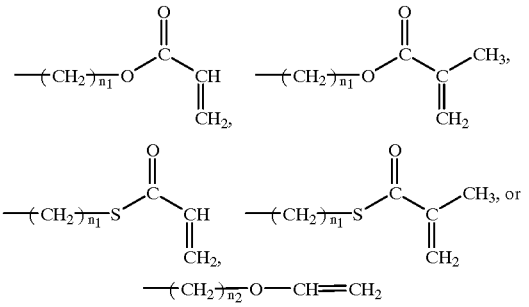

where $n_1$ is an integer from 3 to 12 and where $n_2$ is an integer from 2 to 10.

In formula (I), the value of n ranges from about 50 to 1000, preferably ranging from about 100 to 200. Reactive group $R_1$ can be a vinyl ether group or an alpha, beta unsaturated carbonyl group. Alpha, beta unsaturated carbonyl groups include acrylates, methacrylates, thioacrylates, and thiomethacrylates. The preferred reactive group $R_1$ is a methacrylate. When $R_1$ is an alpha, beta unsaturated carbonyl group, the value of $n_1$ ranges from 3 to 12, preferably ranging from 3 to 5. When R is a vinyl ether group, the value of $n_2$ ranges from 2 to 10, preferably ranging from 2 to 5. In formula (I), $R_3$ may be a reactive group (i.e., an alpha, beta unsaturated carbonyl group or a vinyl ether group) or a non-reactive group. When $R_3$ is a non-reactive group, the siloxane polymer of formula (I) is monofunctional. When $R_3$ is a reactive group, the siloxane polymer of formula (I) is difunctional. When $R_3$ is a reactive group, it may be a vinyl ether group or an alpha, beta unsaturated carbonyl group, for example, an acrylate, methacrylate, thioacrylate or thiomethacrylate group. The preferred alpha, beta unsaturated carbonyl group is a methacrylate. When $R_3$ is an alpha, beta unsaturated carbonyl group, the value of $n_1$ typically ranges from 3 to 12, preferably ranging from 3 to 5. When $R_3$ is a vinyl ether group, the value of $n_2$ typically ranges from 2 to 10, preferably ranging from 2 to 5. Non-reactive groups include aliphatic groups having from 1 to 10 carbon atoms and aromatic groups. As used herein "aromatic" or "aromatic group" refers to a group containing at least one conjugated unsaturated cyclic hydrocarbon. As used herein "aliphatic" or "aliphatic group" refers to straight, branched or alicyclic hydrocarbons which may optionally contain sites of unsaturation. Preferably, the aromatic group has from 6 to 12 carbon atoms. The preferred non-reactive groups are methyl, ethyl and phenyl groups.

Pendant group $R_2$ may be independently methyl, ethyl, or phenyl, with methyl being preferred. By independently, it is meant that pendant groups $R_2$ may be different from one another. For example, the pendant groups bonded to a single silicon atom may be different from one another or the pendant groups may vary along the polymer chain in random, alternating, or block copolymer fashion. Combinations of the foregoing are also within the scope of this invention. Preferably, the pendant groups are all methyl groups.

The molecular weight of the siloxane polymer of formula (I) typically ranges from about 1,000 to about 100,000 grams/mole, preferably ranging from about 2,000 to about 50,000 grams/mole, more preferably ranging from about 2,500 to about 20,000 grams/mole, and most preferably ranging from about 5,000 to about 10,000 grams/mole. If the molecular weight is too low, the siloxane polymer may not provide sufficient release properties. Alternatively, if the molecular weight is too high, the siloxane polymer may inhibit the polymerization of the binder precursor and/or may act as a plasticizer.

Preferred reactive siloxane polymers of formula (I) include, for example, poly(dimethylsiloxane) monomethacrylate (commercially available having a n-butyldimethylsilyl end group as catalog number 39,630-3 from Sigma-Aldrich Chemical Co., Milwaukee, Wis.).

A tetrafunctional reactive siloxane polymer is represented by the general formula (II):

(II)

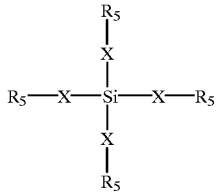

In formula (II), X is:

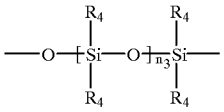

where $n_3$ is an integer from 5 to 500 and where the terminal oxygen atom of X is connected to the Si atom of formula (II).

$R_4$ is independently methyl, ethyl, or phenyl.

$R_5$ is independently:

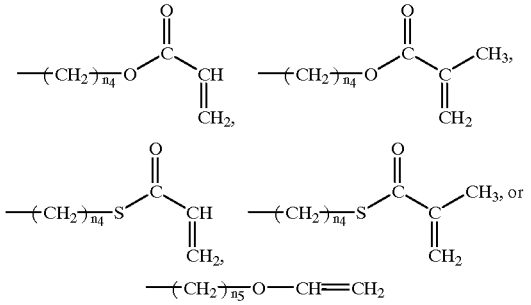

where $n_4$ is an integer from 3 to 12 and where $n_5$ is an integer from 2 to 10.

In formula (II), the value of $n_3$ ranges from about 5 to 500, preferably ranging from about 10 to 100. When $R_5$ is an alpha beta unsaturated carbonyl group, the value of $n_4$ ranges from 3 to 12, preferably ranging from 2 to 5. When $R_5$ is a vinyl ether group, the value of $n_5$ ranges from 2 to 10, preferably ranging from 2 to 5.

Pendant group $R_4$ may be independently methyl, ethyl, or phenyl. By independently, it is meant that pendant groups $R_4$ may be different from one another. For example, the pendant groups bonded to a silicon atom may be different from one another or the pendant groups may vary along the polymer chain in random, alternating, or block copolymer fashion. Combinations of the foregoing are also within the scope of this invention. Preferably, pendant groups $R_4$ are methyl groups.

$R_5$ groups may be, independently, vinyl ether groups or alpha, beta unsaturated carbonyl groups such as acrylates, methacrylates, thioacrylates, or thiomethacrylates. Preferably, $R_5$ are alpha, beta unsaturated carbonyl groups, most preferably methacrylate groups.

The molecular weight of the siloxane polymer of formula (II) typically ranges from about 1,000 to about 100,000 grams/mole, preferably ranging from about 2,000 to about 50,000 grams/mole, more preferably ranging from about 2,500 to about 20,000 grams/mole, and most preferably ranging from about 5,000 to about 10,000 grams/mole. If the molecular weight is too low, the siloxane polymer may not provide sufficient release properties. Alternatively, if the molecular weight is too high, the siloxane polymer may inhibit the polymerization of the binder precursor and/or act as a plasticizer.

The selection of the particular reactive siloxane polymer and the amount may depend upon factors such as the intended abrading application of the abrasive article, the desired processing conditions, and the type of backing. For example, the siloxane polymer may tend to increase the viscosity of the abrasive slurry. Thus, one skilled in the art may formulate the abrasive slurry to provide the desired release properties without unduly increasing the viscosity of the abrasive slurry.

In typical abrasive slurries, the reactive siloxane polymer of formula (I) or (II) will comprise by weight about 0.1% to 40% of the total weight of the binder precursor and the reactive siloxane polymer, preferably about 0.5% to 20%, and most preferably about 1% to 10% of the total weight of the binder precursor and the reactive siloxane polymer. For example, a preferred slurry may include 5 parts reactive siloxane polymer and 95 parts binder precursor (i.e., 5% total weight reactive siloxane polymer).

The reactive groups of the siloxane polymer are selected to be reactively compatible with the reactive groups of the binder precursor. That is, the reactive groups of the binder precursor should react with the reactive groups of the siloxane polymer during the cure of the binder precursor. In this way, the siloxane polymer becomes chemically bound to the cured binder precursor. For binder precursors which cure via free radical polymerization (e.g., acrylate functional binder precursors), the siloxane polymer will preferably have at least one reactive group (e.g., an acrylate group) which will react with the binder precursor via a free radical mechanism. For binder precursors which cure via cationic mechanism (e.g., vinyl ether functional binder precursors such as 4-hydroxylbutyl vinyl ether, triethylene glycol vinyl ether), the siloxane polymer will preferably have at least one reactive group (e.g., a vinyl ether group) which will react with the binder precursor via a cationic mechanism. Mixtures of binder precursors having free radically and cationically polymerizable reactive groups are also within the scope of this invention.

Additives:

The abrasive coating of an abrasive article of the present invention may further comprise optional additives, such as, plasticizers, abrasive particle surface modification additives, coupling agents, fillers, expanding agents, fibers, antistatic agents, initiators, suspending agents, photosensitizers, lubricants, wetting agents, surfactants, pigments, dyes, UV stabilizers or suspending agents. The amounts of these materials are selected to provide the desired property.

Plasticizers include polyvinyl chloride, dibutyl phthalate, alkyl benzyl phthalate, polyvinyl acetate, polyvinyl alcohol, cellulose esters, phthalate, silicone oils, adipate and sebacate esters, polyols, polyol derivatives, t-butylphenyl diphenyl phosphate, tricresyl phosphate, castor oil, and combinations thereof.

Surface modification additives include wetting agents, surfactants, and coupling agents. A coupling agent may provide an association bridge between the binder and the abrasive particles. Additionally, the coupling agent may provide an association bridge between the binder and the filler particles. Examples of coupling agents include, for example, silanes, titanates, and zircoaluminates.

A filler is a particulate material which has an average particle size in the range from about 0.1 to about 50 micrometers, typically in the range from about 1 to about 30 micrometers. Examples of fillers include metal carbonates (e.g., calcium carbonate (chalk, calcite, marl, travertine, marble and limestone), calcium magnesium carbonate, sodium carbonate, magnesium carbonate), silica (e.g., quartz, glass beads, glass bubbles and glass fibers), silicates (e.g., talc, clays, (montmorillonite) feldspar, mica, calcium silicate, calcium metasilicate, sodium aluminosilicate, sodium silicate), metal sulfates (e.g., calcium sulfate, barium sulfate, sodium sulfate, aluminum sodium sulfate, aluminum sulfate), gypsum, vermiculite, wood flour, aluminum trihydrate, carbon black, metal oxides (e.g., calcium oxide (e.g., lime), aluminum oxide, tin oxide (e.g. stannic oxide), titanium dioxide) and metal sulfites (e.g., calcium sulfite), thermoplastic particles (e.g., polycarbonate, polyetherimide, polyester, polyethylene, polysulfone, polystyrene, acrylonitrile-butadiene-styrene block copolymer, polypropylene, acetal polymers, polyurethanes, and nylon particles) and thermosetting particles (e.g., phenolic bubbles, phenolic beads, polyurethane foam particles and the like). The filler may also be a salt such as a halide salt. Examples of halide salts include sodium chloride, potassium cryolite, sodium cryolite, ammonium cryolite, potassium tetrafluoroboate, sodium tetrafluoroborate, silicon fluorides, potassium chloride, magnesium chloride. Examples of metal fillers include, tin, lead, bismuth, cobalt, antimony, cadmium, iron titanium. Other miscellaneous fillers include sulfur, organic sulfur compounds, graphite and metallic sulfides.

An example of a suspending agent is an amorphous silica particle having a surface area less than 150 meters square/gram that is commercially available from DeGussa Corp., under the trade name "OX-50". The addition of the suspending agent can lower the overall viscosity of the abrasive slurry. The use of suspending agents is further described in U.S. Pat. No. 5,368,619 (Culler), the disclosure of which is incorporated herein by reference.

Curing Agents:

A curing agent is a material that initiates and/or completes the cure (typically a polymerization and/or crosslinking process) of the binder precursor such that the binder precursor is converted into a binder. The term "curing agent" is used herein to refer to initiators (e.g., thermal initiators and photoinitiators), catalysts and activators. The type and amount of the curing agent typically depends upon the reactive functionality of the binder precursor and/or the reactive siloxane polymer or the desired initiation energy source.

Polymerization of ethylenically unsaturated binder precursors occurs via a free-radical chain polymerization mechanism. The curing agent, which is typically referred to as an initiator, functions to provide a source of free radicals to initiate the free radical polymerization. Examples of initiators that provide a source of free-radicals upon exposure to ultraviolet light (i.e., a photoinitiator) and/or heat include, for example, organic peroxides, azo compounds, quinones, nitroso compounds, acyl halides, hydrazones, mercapto compounds, pyrylium compounds, imidazoles, chlorotriazines, benzoin, benzoin alkyl ethers, diketones, phenones, and mixtures thereof. Example of commercially available photoinitiators include those known under the trade designations "IRGACURE 651" and "IRGACURE 184" (available from the Ciba Geigy Company) and "DAROCUR 1173" (available from Merck, Germany). Typically, the initiator is used in an amount ranging from about 0.1% to about 10%, preferably ranging from about 2% to about 4% by weight, based on the total weight of the binder precursor and reactive siloxane polymer. It is preferable to uniformly disperse the initiator in the binder precursor prior to the addition of any particulate material (e.g., abrasive particles and/or filler particles).

An electron beam may also be used to initiate the polymerization of free radically polymerizable binder precursors. Electron beams generate free radicals directly (i.e., without the need for a chemical initiator). However, it is within the scope of this invention to use initiators even if the binder precursor is exposed to an electron beam.

It is also within the scope of this invention to use a photosensitizer or a photoinitiator system which affects polymerization either in air or in an inert atmosphere (e.g., nitrogen). These photosensitizer or photoinitiator systems include compounds having carbonyl groups, compounds having tertiary amino groups, and mixtures thereof. Preferred compounds having carbonyl groups include, for example, benzophenone, acetophenone, benzil, benzaldehyde, o-chlorobenzaldehyde, xanthone, thioxanthone, 9,10-anthraquinone, or aromatic ketones which can act as photosensitizers. Preferred tertiary amines include, for example, methyldiethanolamine, ethyldiethanolamine, triethanolamine, phenylmethylethanolamine or dimethylaminoethylbenzoate.

Cationic curing agents generate an acid source to initiate the polymerization of an epoxy resin or a vinyl ether resin. These cationic curing agents can include a salt having an onium cation and a halogen containing a complex anion of a metal or metalloid.

Other cationic curing agents include a salt having an organometallic complex cation and a halogen containing a complex anion of a metal or metalloid which are further described in U.S. Pat. No. 4,751,138 (Tumey et al.), the disclosure of which is incorporated herein by reference. Another example is an organometallic salt and an onium salt as described in U.S. Pat. No. 4,985,340 (Palazotto et al.) and European Published Patent Applications 306,161 and 306,162, the disclosures of which are incorporated herein by reference. Still other cationic curing agents include an ionic salt of an organometallic complex in which the metal is selected from the elements of group IVB, VB, VIB, VIIB and VIIIB of the Periodic Table of the Elements. Such cationic curing agents are reported in European Published Patent Application No. 109,581, the disclosure of which is incorporated herein by reference.

Cationic photoinitiators include aryl-sulphonium photoinitiators commercially available under the trade designation "CYRACURE UVI 6921" and "CYRACURE UVI 6990" (available from Union Carbide, Danbury, Conn.) and "DEGACURE KI-85" (available from Degussa Corp., Ridgefield Park, N.J.).

Backings:

An abrasive article of the present invention comprises an abrasive coating bonded to a backing. Examples of abrasive backings include polymeric film, primed polymeric film, metal foil, cloth, paper, metal plates, vulcanized fiber, nonwovens, and treated versions thereof and combinations thereof. Suitable backings may optionally contain treatments to modify their physical properties or a presize coating or primer coating which is disposed between the backing and the abrasive coating. The backing may also comprise two or more backings laminated together. The backing may also comprise reinforcing fibers engulfed in a polymeric material, as reported in PCT WO 93/12911 (Benedict et al.), the disclosure of which is incorporated herein by reference. The thickness of the backing typically ranges from about 20 to about 5000 micrometers, preferably ranging from about 50 to about 2500 micrometers.

Reactive siloxane polymers are particularly preferred in abrasive articles having porous or non-continuous backings. Examples of such backings include porous nonwovens, porous papers, rebulkable nonwovens, perforated backings, screen cloths, untreated cloth and the like. Examples of rebulkable nonwoven backings are further described in the co-pending patent application Ser. No. 09/218,385 "NON-WOVEN ABRASIVE ARTICLES AND METHODS OF PREPARING SAME"), filed the same day as the instant application, the disclosure of which is incorporated herein by reference.

The addition of the reactive siloxane polymer aids in the release or removal of the abrasive coating from the production tool. This release property is particularly advantageous for manufacturing structured abrasive articles having porous (e.g., nonwoven) backings. When manufacturing such abrasive articles, the adhesion between the abrasive coating and the production tool may be greater than the internal strength of the backing and/or the bond between the abrasive coating and the backing. In these instances, when the abrasive coating is removed from the production tool the backing may split and/or the abrasive coating may separate from the backing. By including a reactive siloxane polymer in the abrasive coating, the adhesion between the abrasive coating and the production tool is reduced thereby allowing the abrasive coating to be more easily removed from the production tool.

Release from the production tool is important not only to prevent damage to the abrasive article. For example, if the abrasive coating sticks to the production tool this may reduce the number of times that the production tool can be reused since it becomes clogged with residual abrasive coating.

Utilization of reactive siloxane polymers is a particularly advantageous way of providing release from a production tool in that these materials, which are chemically bonded to the binder, do not typically transfer to the surface of the workpiece during abrading. The transfer of any release promoting material to the surface of a workpiece by an abrasive article is generally disfavored since this may interfere with the adhesion and/or wetting of coatings which are subsequently applied over the abraded surface.

Method of Making An Abrasive Article:

The present invention also provides a method of making an abrasive article comprising the steps of:

(a) providing a production tool comprising a major surface having a plurality of precisely shaped cavities formed therein;

(b) filling the precisely shaped cavities with an abrasive slurry, the abrasive slurry comprising:
- a plurality of abrasive particles;
- a binder precursor; and
- a reactive siloxane polymer comprising at least one of formulas (I) or (II) or a mixture thereof;

(c) laminating a major surface of a backing to the surface of the production tool so that at least a portion of the major surface of the backing is in direct contact with the surface of the production tool;

(d) exposing the abrasive slurry to an energy source to at least partially cure the binder precursor thereby forming an abrasive article; and (e) removing the abrasive article from the production tool.

The production tool of step (a) has a major surface (defining a main plane) which contains a plurality of precisely shaped cavities distending as indentations from the main plane. These cavities are responsible for generating the shape and placement of the abrasive composites on the backing. The cavities may be provided in any geometric shape that is the inverse of a geometric shape which is suitable for an abrasive composite. Typical shapes include cubes, cylinders, prisms, hemispheres, rectangles, pyramids, truncated pyramids, cones, truncated cones, and post-like with a flat top surface. The dimensions and locations of the cavities in the production tool are selected to achieve the desired areal density of abrasive composites. Preferably, the shape of the cavities is selected such that the surface area of the abrasive composite decreases away from the backing.

The production tool can take the form of a belt, sheet, continuous sheet or web, coating roll such as a rotogravure roll, sleeve mounted on a coating roll, or die. The production tool can be composed of metal, (e.g., nickel), metal alloys, or plastic. The metal production tool can be fabricated by any conventional technique including, but not limited to, photolithography, knurling, engraving, hobbing, electroforming, and diamond turning.

A production tool made of thermoplastic material can be replicated from a master tool. When a production tool is replicated from a master tool, the master tool is provided with the inverse of the pattern which is desired for the production tool. The master tool is preferably made of a nickel-plated metal, such as nickel-plated aluminum, nickel-plated copper, or nickel-plated bronze. A production tool can be replicated from a master tool by pressing a sheet of thermoplastic material against the master tool while heating the master tool and/or the thermoplastic sheet such that the thermoplastic material is embossed with the master tool pattern. Alternatively, the thermoplastic material can be extruded or cast directly onto the master tool. The thermoplastic material is then cooled to a solid state and is then separated from the master tool to produce a production tool. The production tool may optionally be treated with a release coating to permit easier release of the abrasive article. Examples of such release coatings include silicones and fluorochemicals.

Preferred methods for the production of production tools are disclosed in U.S. Pat. No. 5,435,816 (Spurgeon et al.), U.S. Pat. No. 5,658,184 (Hoopman et al.), and in U.S. Ser. No. 08/923,862 (Hoopman) filed Sep. 3, 1997, the disclosures of which are incorporated herein by reference.

In one aspect of this method, an abrasive slurry is coated directly onto the front surface of a backing using any conventional coating technique such as, for example, roll coating, transfer coating, spraying, die coating, vacuum die coating, knife coating, curtain coating, or rotogravure coating. The production tool is then brought into contact with the abrasive slurry-coated backing such that the abrasive slurry flows into the cavities of the production tool. Pressure may be applied by a nip roll or other suitable technique in order to force the abrasive slurry to flow in and fill the cavities of the production tool.

In a preferred aspect of this method, the cavities are filled by coating the abrasive slurry directly onto the production tool. This can be accomplished by any conventional coating method. The backing is then brought into contact with the surface of the production tool such that the abrasive slurry-coated production tool wets the surface of the backing. Pressure may be applied by a nip roll or other suitable technique in order to force the abrasive coating against the backing.

Once coated, the abrasive slurry is exposed to an energy source in order to convert the binder precursor and reactive siloxane polymer to a cured binder. Cure is typically the result of a polymerization and/or crosslinking process. The energy source may be thermal energy, electron beam, ultraviolet light, or visible light. If the production tool is made from a material transparent to visible or ultraviolet radiation (e.g., polypropylene or polyethylene thermoplastic) then visible or ultraviolet light may be transmitted through the production tool to cure the binder precursor and reactive siloxane polymer. When thermal energy is used, the oven temperature typically ranges from about 50° C. to about 250° C., and the exposure time typically ranges from about 15 minutes to about 16 hours. For free radically curable binder precursors initiated by photoinitiators, the UV or visible radiation energy level (in the absence of heating) should be at least about 100 milliJoules/$cm^2$, more preferably from about 100 to about 700 milliJoules/$cm^2$, and most preferably from about 400 to about 600 milliJoules/$cm^2$. Ultraviolet radiation refers to electromagnetic radiation having a wavelength in the range of about 200 to about 400 nanometers, preferably within the range of about 250 to 400 nanometers. Visible radiation refers to electromagnetic radiation having a wavelength in the range of about 400 to about 800 nanometers, preferably in the range of about 400 to about 550 nanometers. An electron beam may be used at an energy level of about 0.1 to about 10 Mrad, preferably at an energy level of about 1 to about 10 Mrad, at accelerating potential ranging from about 150 to about 300 kiloelectron volts. Following cure of the binder precursor and reactive siloxane polymer (i.e., formation of a binder), the backing having the abrasive coating bonded thereto is separated from the production tool. The resulting structured abrasive coating has the inverse pattern of the production tool. That is, the abrasive coating comprises a plurality of precisely shaped abrasive composites wherein the composites have the inverse shape of the precisely shaped cavities of the production tool.

The precisely shaped abrasive composites of a structured abrasive article of the present invention may be any shape. Typically, the surface area of the base side of the shape that is in contact with the backing is larger in value than that of the distal end of the composite spaced from the backing. The shape of the composite may be selected from among a number of geometric shapes such as a cubic, cylindrical, prismatic, pyramidal, truncated pyramidal, conical, truncated conical, cross, or post-like with a top surface which is flat. Hemispherical abrasive composites are described in WO 95/22436 (Hoopman et al.), the disclosure of which is incorporated herein by reference. The resulting abrasive article may have a mixture of abrasive composites having different shapes and/or sizes. It is also within the scope of this invention, that all of the abrasive composites have essentially the same shape, however the orientation of individual abrasive composites may be different from one another.

The sides forming the abrasive composites may be straight or they can be tapered. If the sides are tapered, it is easier to remove the abrasive composite from the cavities of the production tool. The angle forming the taper can range from about 1° to about 75°, preferably from about 2° to about 50°. The base abrasive composites can abut one another or the bases of adjacent abrasive composites may be separated from one another by some specified distance. The area spacing of abrasive composites typically ranges from about 1 to about 12,000 composites/$cm^2$, preferably ranging from about 50 to about 7,500 composites/$cm^2$. The spacing of the abrasive composites can range from about 1 to about 100 composites per linear centimeter, preferably ranging from about 5 to about 80 composites per linear centimeter. The abrasive composites may be positioned on the backing in any array or arrangement. For example, the abrasive composites in adjacent rows may be directly aligned with one another or abrasive composites in adjacent rows may be offset from one another. The height of the abrasive composites is typically less than about 2000 micrometers, more preferably ranging from about 25 to about 1000 micrometers. The diameter or cross sectional width of the abrasive composites typically ranges from about 5 to about 500 micrometers, preferably ranging from about 10 to about 250 micrometers. Additional details on precisely shaped abrasive composites can be found in U.S. Pat. No. 5,152,917 (Pieper et al.), PCT WO 97/11484 (Bruxvoort et al.) and PCT WO 95/07797 (Hoopman et al.), the disclosures of which are incorporated herein by reference.

EXAMPLES

All parts are by weight unless otherwise specified. The following designations are used throughout the examples.

TABLE 1

Materials List

| Designation | Description of Material |
|---|---|
| PB1 | A C-weight paper backing commercially available from Kimberly Clark of that was treated with a latex treatment to render the paper waterproof. The front surface of this paper backing had an arithmetic mean surface roughness of 143 micrometers as measured by a profilometer. |
| TATHEIC | Triacrylate of tris(hydroxy ethyl) isocyanurate commercially available from Sartomer, Exton, PA under the trade designation of "SR368" |
| TMPTA | Trimethylolpropane triacrylate commercially available from Sartomer, Exton, PA. under the trade designation "Sartomer 351" |
| THFA | Tetrahydrofuran acrylate commercially available from Sartomer of Exton, PA under the trade designation of "SR 285" |
| P820 | sodium aluminum silicate filler, commercially available from Degussa Corp. under the trade designation "P820." |
| RSP | Poly(dimethylsiloxane)monomethacrylate having a number average molecular weight ranging from about 9,000 to 12,000 grams/mole commercially available as catalog number 39,630-3 from Sigma-Aldrich Corporation, St. Louis, MO. The structure of RSP fits formula (I) where: n ranges from about 120 to 160, $R_1$ is: 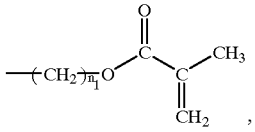 , $n_1$ is 3, $R_2$ is methyl, and $R_3$ is butyl. |
| CA1 | A 3-methacryloxypropyltrimethoxysilane coupling agent commercially available from OSI, Danbury, CT. under the trade designation "A-174" |
| D-111 | ionic dispersing agent, commercially available from Byk Chemie, Wallingford, CT under the trade designation "Disperbyk 111". |

TABLE 1-continued

Materials List

| Designation | Description of Material |
|---|---|
| PH1 | 2-methyl-1-(4-(methylthio)phenyl)-2-(4-morpholinyl)-1-propanone, commercially available from Ciba Geigy Corp. under the trade designation "Irgacure 907." |
| PH2 | Isopropylthioxanthone commercially available from Biddle-Sawyer Corp. (Distributor for Octel Chemicals, United Kingdom) under the trade designation "Quanticure ITX" |
| OX-50 | amorphous silica filler, commercially available from Degussa Corp. under the trade designation "OX-50." |
| AP1 | Grade 1000 silicon carbide abrasive particles, having a median particle size of about 18 micrometers commercially available from Fujimi Abrasives, Tokyo, Japan. |
| AP2 | Grade 800 silicon carbide abrasive particles, having a median particle size of about 22 micrometers commercially available from Fujimi Abrasives, Japan. |
| AP3 | ANSI grade 1000 green silicon carbide abrasive particles, commercially available from Fujimi Abrasives, Japan. |

General Procedure I for Making Structured Abrasive Articles:

The structured abrasive articles of Example 1, Example 2, Comparative Example A and Comparative Example B were prepared according to the following General Procedure.

First, an abrasive slurry was prepared by thoroughly mixing the materials shown in Table 2. The abrasive particles were gradually added to the binder precursor. A production tool was made by casting polypropylene onto the casting surface of a metal master tool. The casting surface of the master tool contained a planar major surface having a plurality of raised truncated pyramids extending from the casting surface. After solidification of the polypropylene it was removed from the casting tool to form a production tool. The polypropylene production tool contained cavities having a truncated pyramidal shape. The height of the truncated pyramidal cavities was about 80 micrometers, the base was about 178 micrometers per side, and the top was about 51 micrometers per side. The cavities were spaced apart from one another no more than about 510 micrometers. Neighboring cavities formed linear rows extending in a crossweb direction across the production tool. In the downweb direction there were approximately 50 rows of cavities per centimeter.

The polypropylene production tool was secured to a metal carrier plate using masking tape. An abrasive slurry having a formulation as shown in Table 2 was applied to the production tool using a knife coater (gap of 0.025–0.038 mm) such that abrasive slurry filled the cavities of the production tool. Next, PB-1 backing was brought into contact with the slurry-filled production tool such that the major surface of the backing contacted the abrasive slurry which filled the cavities of the production tool. A rubber roller was rolled across the back surface of the backing at a nip pressure of 4.2 kg/cm$^2$ to ensure that the front surface of the backing contacted the abrasive slurry and to remove air bubbles. The abrasive slurry was cured by exposing the slurry to radiation from one "V" bulb operating at 93 Watts/cm (236 Watts/inch) (commercially available from Fusion Systems Inc.). The radiation passed through the production tool before impinging upon the abrasive slurry. The production tool passed under the "V" bulb at a speed of about 14 meters/minute (30 feet/minute). The radiation from the bulb triggered free-radical polymerization (i.e., curing) of the binder precursor and reactive siloxane polymer of the abrasive slurry thereby converting the abrasive slurry into an abrasive coating. Once cured, the backing having the abrasive coating adhered thereto was separated from the production tool.

TABLE 2

Abrasive Slurry Formulations

| Component | Slurry A | Slurry 1 | Slurry B | Slurry 2 |
|---|---|---|---|---|
| TATHEIC | 25.86 | 25.1 | 25.86 | 25.1 |
| TMPTA | 60.34 | 58.57 | 60.34 | 58.57 |
| THFA | 70.3 | 68.24 | 70.3 | 68.24 |
| CA1 | 3.9 | 3.78 | 3.9 | 3.78 |
| PH1 | 3.1 | 3 | 3.1 | 3 |
| PH2 | 1.5 | 1.45 | 1.5 | 1.45 |
| P820 | 6 | 2.85 | 6 | 2.85 |
| AP1 | 320 | 320 | 0 | 0 |
| AP2 | 0 | 0 | 320 | 320 |
| RSP | 0 | 4.91 | 0 | 4.91 |

Example 1

Example 1 was prepared according to General Procedure I using Slurry 1.

Example 2

Example 2 was prepared according to General Procedure I using Slurry 2.

Comparative Example A

Comparative Example A was prepared according to General Procedure I using Slurry A.

Comparative Example B

Comparative Example B was prepared according to General Procedure I using Slurry B.

Comparative Example C

401Q Imperial Wetordry Paper, A Wt., Grade 1200, (available from Minnesota Mining and Manufacturing Company, St. Paul, Minn.).

Comparative Example D

Nikken Silicon Carbide Water Proof Paper, Grade 1200-Cw (available from Nihonkenshi Co., LTD, Japan) (also available as Unigrit Finishing Paper Grade 1200 from Meguiar's Inc., Irvine, Calif.).

Comparative Example E

401Q Imperial Wetordry Paper, A Wt., Grade 1000, (available from Minnesota Mining and Manufacturing Company, St. Paul, Minn.).

Comparative Example F

Nikken Silicon Carbide Water Proof Paper, Grade 1000-Cw (available from Nihonkenshi Co., LTD, Japan) (also available as Unigrit Finishing Paper Grade 1000 from Meguiar's Inc., Irvine, Calif.).

The cutting performance and surface finish (i.e., the surface finish imparted to a workpiece abraded by the abrasive article) for abrasive articles of the present invention and the comparative examples was characterized using the following procedure.

Substrate Preparation:

Test panels were prepared by applying an acrylic urethane paint to steel panels. The acrylic urethane paint formulation included 2 parts by weight clearcoat (commercially available under the trade designation "DAU 82" "DELGLO" from PPG Industries, Strongsvill, Ohio), 1 part by weight reducer (commercially available under the trade designation "DT 870" from PPG Industries), and 2 parts by weight catalyst (commercially available under the trade designation "DAU2" "DELTRON" from PPG Industries). The acrylic urethane paint was applied to steel panels (available from ACT Company, Hillsdale, Mich.) using a Binks Model 7 spray gun operating under 40 psi pressure. The panels had previously been coated with DBU basecoat (commercially available from PPG Industries). Two coats of urethane paint each having a dry thickness of 1.5 to 2.0 mils were applied to each panel. The paint was allowed to cure for 24 hours at room temperature prior to testing.

Abrasive Article Performance Testing:

The abrasive article to be tested was attached to a 3M No. 20 flexible foam sanding pad (available from Minnesota Mining and Manufacturing Company, St. Paul, Minn.). The sanding pad having the abrasive article attached was used to hand abrade the coated surface of a test panel for a period of 45 seconds. After the 45 second sanding period, the performance of the abrasive was quantitated by measuring the thickness of the coating remaining on the test panel and by measuring the surface roughness of the coating. The thickness of the coating on the test panel was measured using a Elcometer 256F coating thickness gauge (available from Elcometer Inc., Brimingham, Mich.). Table 3 and 6 report the change in thickness of the coating. The surface roughness of the coating on the test panel was measured using a Perthometer (available from Feinpruf GmbH, Gottingen, Germany) and is reported as Ra (Ra is the arithmetic average of the scratch depth) and Rtm (Rtm is the mean of the maximum peak to valley height). The process was repeated three additional times (i.e., each abrasive article was tested for a total of 180 seconds comprising four separate 45 second sanding intervals). In between each sanding interval, the abrasive article was submersed in water to remove swarf. The results of the testing are summarized in Tables 3–8.

TABLE 3

| | Change in Coating Thickness (micrometers) | | | |
|---|---|---|---|---|
| Time (sec) | Comp. Ex. C | Comp. Ex. A | Example 1 | Comp. Ex. D |
| 45 | 3.8 | 2.8 | 3.6 | 3.4 |
| 90 | 7.7 | 6.0 | 7.9 | 6.4 |
| 135 | 11.5 | 9.3 | 12.1 | 8.6 |
| 180 | 15.3 | 12.4 | 15.9 | 10.9 |

TABLE 4

| | Ra (micrometers) | | | |
|---|---|---|---|---|
| Time (sec) | Comp. Ex. C | Comp. Ex. A | Example 1 | Comp. Ex. D |
| 45 | 0.20 | 0.21 | 0.17 | 0.19 |
| 90 | 0.19 | 0.20 | 0.16 | 0.18 |
| 135 | 0.19 | 0.19 | 0.18 | 0.18 |
| 180 | 0.17 | 0.20 | 0.18 | 0.16 |

TABLE 5

| | Rtm (micrometers) | | | |
|---|---|---|---|---|
| Time (sec) | Comp. Ex. C | Comp. Ex. A | Example 1 | Comp. Ex. D |
| 45 | 1.6 | 1.7 | 1.4 | 1.5 |
| 90 | 1.5 | 1.6 | 1.3 | 1.5 |

TABLE 5-continued

| | Rtm (micrometers) | | | |
|---|---|---|---|---|
| Time (sec) | Comp. Ex. C | Comp. Ex. A | Example 1 | Comp. Ex. D |
| 135 | 1.6 | 1.6 | 1.5 | 1.4 |
| 180 | 1.4 | 1.6 | 1.4 | 1.3 |

TABLE 6

| | Change in Coating Thickness (micrometers) | | | |
|---|---|---|---|---|
| Time (sec) | Comp. Ex. E | Comp. Ex. B | Example 2 | Comp. Ex. F |
| 45 | 4.5 | 4.5 | 5.4 | 4.7 |
| 90 | 8.8 | 8.5 | 11.0 | 7.7 |
| 135 | 12.9 | 12.7 | 16.5 | 10.4 |
| 180 | 16.6 | 15.5 | 20.8 | 14.4 |

TABLE 7

| | Ra (micrometers) | | | |
|---|---|---|---|---|
| Time (sec) | Comp. Ex. E | Example 2 | Comp. Ex. B | Comp. Ex. F |
| 45 | 0.34 | 0.27 | 0.25 | 0.28 |
| 90 | 0.29 | 0.25 | 0.24 | 0.23 |
| 135 | 0.27 | 0.24 | 0.23 | 0.23 |
| 180 | 0.25 | 0.23 | 0.23 | 0.23 |

TABLE 8

| | Rtm (micrometers) | | | |
|---|---|---|---|---|
| Time (sec) | Comp. Ex. E | Example 2 | Comp. Ex. B | Comp. Ex. F |
| 45 | 2.7 | 2.2 | 2.1 | 2.2 |
| 90 | 2.3 | 2.0 | 2.0 | 1.9 |
| 135 | 2.3 | 2.0 | 1.9 | 2.0 |
| 180 | 2.1 | 1.9 | 1.9 | 1.9 |

Example 2 and Comp. Ex. B were structured abrasive articles having a abrasive coating comprising a plurality of precisely shaped abrasive composites.

These abrasive articles were designed to perform similar to 1000 grade Wet-or-Dry coated abrasive articles. The abrasive coatings of Example 2 and Comp. Ex. B had similar compositions except that Example 2 contained a reactive siloxane polymer. The data in Tables 6–8 demonstrates that Example 2 provides a higher cut rate than Comp. Ex. B. Example 2 also provided a higher cut rate and finer surface finish than Comp. Examples E and F. There was no indication that the reactive siloxane polymer in Example 2 had transferred to the surface of the workpiece.

Example 1 and Comp. Ex. A were structured abrasive articles having a abrasive coating comprising a plurality of precisely shaped abrasive composites. These abrasive articles were designed to perform similar to 1200 grade Wet-or-Dry coated abrasive articles. The abrasive coatings of Example 1 and Comp. Ex. A had similar compositions except that Example 1 contained a reactive siloxane polymer. The data in Tables 3–5 demonstrates that Example 1 provides a higher cut rate than Comp. Ex. A. Example 1 also provided a higher cut rate and finer surface finish than Comp. Examples C and D. There was no indication that the reactive siloxane polymer in Example 1 had transferred to the surface of the workpiece.

Adhesion of Tape to Abrasive Coatings.

le;.5qThis test was used to characterize the release properties of abrasive coatings from a production tool. The peel force necessary to remove tape from the surface of various abrasive coatings was measured. Peel force measurements were used to characterize the release properties of the surface of abrasive coatings. That is, low peel forces characterize a surface which is difficult to bond to. Therefore, a low peel force indicates formulations which may be preferred for release from a production tool.

First, a 3.2 cm by 10.2 cm sample strip of abrasive was affixed to the working platen of a slip/peel tester (model SP-102B-3M90 from Instrumentors, Inc equipped with an MB-10 load cell) using double stick tape. Next, 3M #202 masking tape (2.5 cm width) was adhered to the surface of the abrasive coating. The tape was pressed in contact with the abrasive coating using a 6.8 kg (3.1 lb) roller which was passed over the tape 3 times. Immediately after rolling, the tape was peeled from the surface of the abrasive coating at a peel rate of 228 cm/min and at an angle of 180°. The force required to peel the tape from the abrasive coating was measured for a period of 2 seconds and the average peel force over the 2 second interval was calculated. The results are reported in Table 9.

TABLE 9

| Sample | Average Peel Force (grams/cm) |
|---|---|
| Example 1 | 5.7 |
| Example 2 | 6.3 |
| Comp. Ex. A | 153 |
| Comp. Ex. B | 140 |

The data in Table 9 demonstrates that the force needed to remove tape from the surface of abrasive coatings of the present invention (Examples 1–2) was substantially less than the force needed to remove tape from a comparable abrasive coating which did not contain a reactive siloxane polymer (see, Comp. Ex. A–B). The data in Table 9 suggest that abrasive coatings of the present invention will remove more cleanly from production tools because the surface of the abrasive coating is more difficult to bond to than the surface of an abrasive coatings which does not contain a reactive siloxane polymer.

What is claimed is:

1. An abrasive article comprising:

a backing having a first and a second major surface;

a structured abrasive coating adhered to the first major surface of the backing the abrasive coating comprising a plurality of precisely shaped abrasive composites each of said composites comprising a plurality of abrasive particles dispersed in a binder wherein the binder comprises the reaction product of:

a binder precursor; and at least one reactive siloxane polymer having at least one functional group which reacts with the binder precursor, the reactive siloxane polymer represented by formula (I), or formula (II) wherein formula (I) is:

(I)

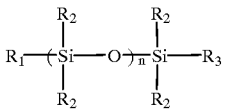

where n is 50 to 1000; and wherein $R_2$ is independently methyl, ethyl, or phenyl; and wherein $R_1$ is:

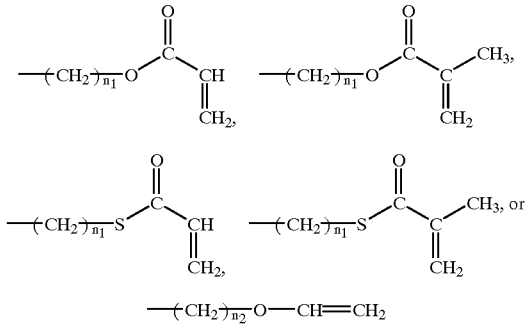

where $n_1$ is an integer from 3 to 12 and where $n_2$ is an integer from 0 to 10; and wherein $R_3$ is:

an aliphatic group having from 1 to 10 carbon atoms, an aromatic group,

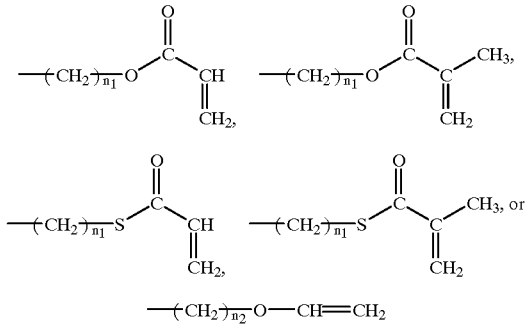

where $n_1$ is an integer from 3 to 12 and where $n_2$ is an integer from 0 to 10; and wherein formula (II) is:

(II)

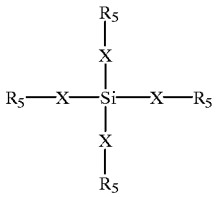

wherein X is:

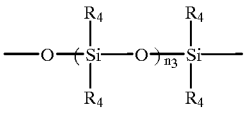

where X has a terminal oxygen atom which is connected to the silicon atom of formula (II) and where $n_3$ is an integer from 5 to 500 and where $R_4$ is independently methyl, ethyl or phenyl;

wherein $R_5$ is independently:

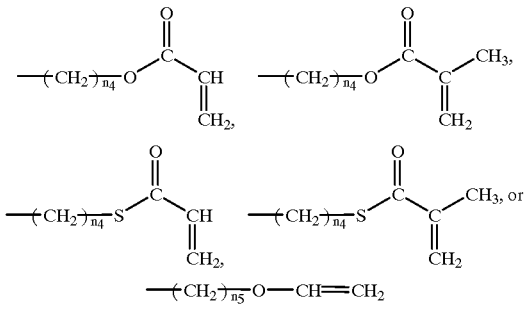

where $n_4$ is an integer from 3 to 12 and where $n_5$ is an integer from 0 to 10.

2. An abrasive article according to claim 1 wherein the binder precursor is free-radically polymerizable.

3. An abrasive article according to claim 2 wherein the binder precursor is an acrylate or a methacrylate.

4. An abrasive article according to claim 1 wherein the binder precursor is cationically polymerizable.

5. An abrasive article according to claim 4 wherein the binder precursor is selected from the group consisting of acrylate monomers, acrylated epoxies, acrylated urethanes, acrylated polyesters, acrylated isocyanates, acrylated isocyanurates and mixtures thereof.

6. An abrasive article according to claim 1, wherein the binder comprises about 0.1 to about 10 parts by weight said reactive siloxane polymer.

7. An abrasive article according to claim 1, wherein the binder comprises about 0.5 to about 5 parts by weight said reactive siloxane polymer.

8. An abrasive article according to claim 1, wherein the reactive siloxane polymer comprises formula (I) and wherein n is 100 to 200.

9. An abrasive article according to claim 1, wherein the reactive siloxane polymer comprises formula (I) wherein $R_2$ is methyl.

10. An abrasive article according to claim 1, wherein the reactive siloxane polymer comprises formula (I) wherein $R_1$ and $R_3$ are methacrylates.

11. An abrasive article according to claim 1, wherein the reactive siloxane polymer comprises formula (I) wherein $R_1$ and $R_3$ are acrylates.

12. An abrasive article according to claim 1, wherein the reactive siloxane polymer comprises formula (I) wherein $R_1$ and $R_3$ are vinyl ethers.

13. The abrasive article according to claim 1, wherein the reactive siloxane polymer has a molecular weight ranging from about 2,500 to about 20,000 grams/mole.

14. The abrasive article according to claim 1, wherein the reactive siloxane polymer has a molecular weight ranging from about 5,000 to about 10,000 grams/mole.

15. The abrasive article according to claim 1 wherein the reactive siloxane polymer is poly(dimethylsiloxane) monomethacrylate.

16. The abrasive article according to claim 1, wherein the backing is paper, film, cloth, nonwoven, vulcanized fiber, porous nonwovens, porous papers, rebulkable backings, perforated backings, screen cloths, untreated cloth, or combinations thereof.

17. The abrasive article according to claim 1, wherein the abrasive particles are selected from the group consisting of aluminum oxide, heat treated aluminum oxide, white fused aluminum oxide, black silicon carbide, green silicon carbide, titanium diboride, boron carbide, tungsten carbide, titanium carbide, diamond, silica, iron oxide, chromia, ceria, zirconia, titania, silicates, tin oxide, cubic boron nitride, garnet, fused alumina zirconia, sol gel abrasive particles, and combinations thereof.

18. A method of making a structured abrasive article using a production tool comprising a major surface having a plurality of precisely shaped recesses formed therein, said method comprising the steps of:

(a) filling the precisely shaped recesses of the production tool with an abrasive slurry, the abrasive slurry comprising:

a plurality of abrasive particles;

a binder precursor; and a reactive siloxane polymer having at least one functional group which react with the binder precursor wherein the reactive siloxane polymer comprises at least one of formulas (I) or (II) or mixtures thereof:

wherein formula (I) is:

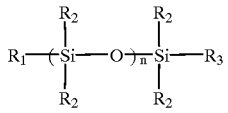

(I)

where n is 50 to 1000; and wherein $R_2$ is independently methyl, ethyl, or phenyl; and wherein $R_1$ is:

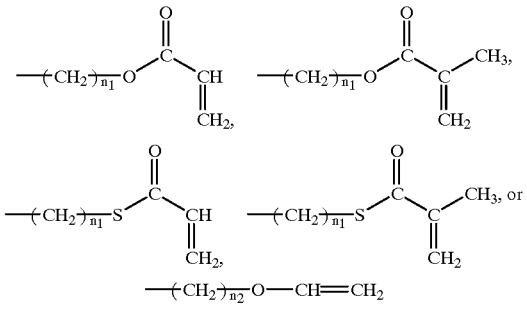

where $n_1$ is an integer from 3 to 12 and where $n_2$ is an integer from 0 to 10; and wherein $R_3$ is:

an aliphatic group having from 1 to 10 carbon atoms, an aromatic group,

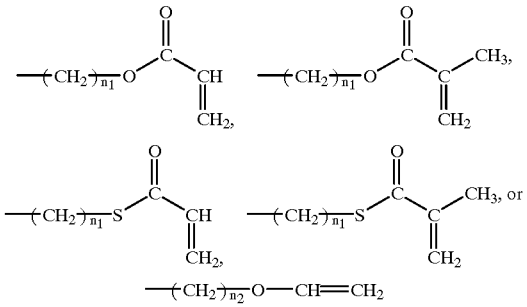

where $n_1$ is an integer from 3 to 12 and where $n_2$ is an integer from 0 to 10; and wherein formula (II) is:

(II)

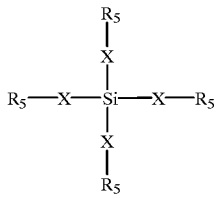

wherein X is:

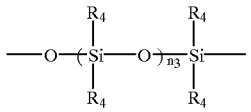

where X has a terminal oxygen atom which is connected to the silicon atom of formula (II) and where $n_3$ is an integer from 5 to 500 and where $R_4$ is independently methyl, ethyl or phenyl;

wherein R is independently:

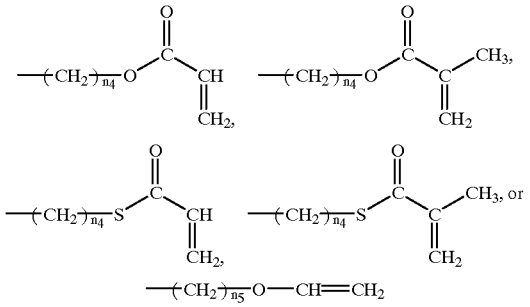

where $n_4$ is an integer from 3 to 12 and where $n_5$ is an integer from 0 to 10;

(b) laminating a major surface of a backing to the major surface of the production tool so that at least a portion of the major surface of the backing is in direct contact with the major surface of the production tool;

(c) subjecting the abrasive slurry to conditions sufficient to at least partially cure the binder precursor and the reactive siloxane polymer thereby forming an abrasive article; and (d) removing the abrasive article from the production tool.

19. The method according to claim 18 wherein the production tool is an endless belt.

20. The method according to claim 18 wherein the production tool comprises a thermoplastic polymer selected from the group consisting of polypropylene, polyethylene and nylon.

21. The method according to claim 18 wherein step (c) comprises expositing the binder precursor to thermal energy, radiation energy or a combination thereof.

22. The method according to claim 21 wherein the radiation energy is ultraviolet light, visible light, or a combination thereof.

23. The method according to claim 18 wherein the binder precursor is free-radically polymerizable.

24. The method according to claim 23 wherein the binder precursor is an acrylate or a methacrylate.

25. The method according to claim 18 wherein the binder precursor is cationically polymerizable.

26. The method according to claim 25 wherein the binder precursor is selected from the group consisting of acrylate monomers, acrylated epoxies, acrylated urethanes, acrylated polyesters, acrylated isocyanates, acrylated isocyanurates and mixtures thereof.

27. The method according to claim 18 wherein the siloxane polymer comprises formula (I) wherein n is 100 to 200.

28. The method according to claim 18 wherein the siloxane polymer comprises formula (I) wherein $R_2$ is methyl.

29. The method according to claim 18 wherein the siloxane polymer comprises formula (I) wherein $R_1$ and $R_3$ are methacrylates.

30. The method according to claim 18 wherein the siloxane polymer comprises formula (I) wherein $R_1$ and $R_3$ are acrylates.

31. The method according to claim 18 wherein the siloxane polymer comprises formula (I) wherein $R_1$ and $R_3$ are vinyl ethers.

32. The method according to claim 18 wherein said reactive siloxane polymer has a molecular weight ranging from about 2,500 to about 20,000 grams/mole.

33. The method according to claim 18 wherein the reactive siloxane polymer has a molecular weight ranging from about 5,000 to about 10,000 grams/mole.

34. The method according to claim 18 wherein the reactive siloxane polymer is poly(dimethylsiloxane) monomethacrylate.

35. The method according to claim 18 wherein the backing is paper, film, cloth, nonwoven, vulcanized fiber, porous nonwovens, porous papers, rebulkable backings, perforated backings, screen cloths, untreated cloth and combinations thereof.

36. An abrasive article made according to the method of claim 18.

37. The method according to claim 18 wherein the reactive siloxane polymer comprises about 0.1% to 40% of a total weight of the binder precursor and the reactive siloxane polymer.

38. The method according to claim 18 wherein the reactive siloxane polymer comprises about 1% to 10% of a total weight of the binder precursor and the reactive siloxane polymer.

* * * * *

UNITED STATES PATENT AND TRADEMARK OFFICE

CERTIFICATE OF CORRECTION

PATENT NO. : 6,238,449 B1
DATED : May 29, 2001
INVENTOR(S) : Woo, Edward J.

It is certified that error appears in the above-identified patent and that said Letters Patent is hereby corrected as shown below:

Column 8,
Line 25, "R" should be -- $R_1$ --.

Column 21,
Line 2, "le;.5qThis test was used" should be -- This test was used --.

Column 26,
Line 2, "expositing" should be -- exposing --.

Signed and Sealed this

Twenty-fifth Day of March, 2003

JAMES E. ROGAN
*Director of the United States Patent and Trademark Office*